US011259630B2

(12) United States Patent
Seal et al.

(10) Patent No.: US 11,259,630 B2
(45) **Date of Patent: *Mar. 1, 2022**

(54) HEIGHT ADJUSTABLE TABLE/DESK CONTROL MECHANISM

(71) Applicant: LINAK A/S, Nordborg (DK)

(72) Inventors: David B. Seal, Chicago, IL (US); Keith D. Alsberg, Evanston, IL (US)

(73) Assignee: Linak A/S, Nordberg (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/796,381

(22) Filed: Feb. 20, 2020

(65) Prior Publication Data

US 2020/0268145 A1 Aug. 27, 2020

Related U.S. Application Data

(63) Continuation of application No. 15/721,253, filed on Sep. 29, 2017, now Pat. No. 10,602,839.

(60) Provisional application No. 62/401,729, filed on Sep. 29, 2016, provisional application No. 62/414,223, filed on Oct. 28, 2016, provisional application No. 62/402,406, filed on Sep. 30, 2016.

(51) Int. Cl.
*A47B 21/02* (2006.01)
*A47B 9/20* (2006.01)

(52) U.S. Cl.
CPC ..... *A47B 21/02* (2013.01); *A47B 9/20* (2013.01); *A47B 2200/0056* (2013.01); *A47B 2200/0061* (2013.01); *A47B 2200/0062* (2013.01)

(58) Field of Classification Search
CPC ... A47B 21/02; A47B 9/00; A47B 2200/0056; A47B 2200/0061; A47B 2200/0062
See application file for complete search history.

(56) References Cited

U.S. PATENT DOCUMENTS

| | | | | |
|---|---|---|---|---|
| 3,080,835 | A | 3/1963 | Guglielmi | |
| 3,839,614 | A | 10/1974 | Saganowski | |
| 5,050,941 | A | 9/1991 | Dahnert | |
| 5,323,695 | A | 6/1994 | Borgman et al. | |
| 5,526,756 | A | 6/1996 | Watson | |
| 5,588,377 | A | 12/1996 | Fahmian | |
| 6,038,986 | A | 3/2000 | Ransil et al. | |
| 6,360,675 | B1 | 3/2002 | Jones | |
| 6,595,144 | B1 * | 7/2003 | Doyle | A47B 9/00 108/147 |
| 7,078,640 | B2 | 7/2006 | Miyake | |
| D794,581 | S | 8/2017 | Lin | |
| D833,981 | S | 11/2018 | Seal | |
| 10,602,839 | B2 * | 3/2020 | Seal | A47B 21/02 |
| 2005/0199520 | A1 | 9/2005 | Nielsen et al. | |

(Continued)

FOREIGN PATENT DOCUMENTS

| | | | |
|---|---|---|---|
| DE | 19604329 | A1 | 8/1997 |
| DE | 29818567 | U1 | 1/1999 |

(Continued)

*Primary Examiner* — Daniel J Rohrhoff
(74) *Attorney, Agent, or Firm* — Dykema Gossett PLLC

(57) ABSTRACT

Various aspects of the present disclosure are directed toward apparatuses, systems, and methods for controlling movement of a desk or table. The apparatuses, systems, and methods may include a housing arranged with the desk or table and a lever configured to initiate raising or lowering of the desk in response to a force applied by a user.

19 Claims, 9 Drawing Sheets

(56) References Cited

U.S. PATENT DOCUMENTS

| | | | | |
|---|---|---|---|---|
| 2006/0061315 | A1 | 3/2006 | Schmidt | |
| 2009/0078167 | A1 | 3/2009 | Ellegaard | |
| 2012/0241301 | A1 | 9/2012 | Chiba et al. | |
| 2013/0199419 | A1 | 8/2013 | Hjelm | |
| 2014/0096706 | A1 | 4/2014 | Labrossse et al. | |
| 2015/0047538 | A1 | 2/2015 | Ergun | |
| 2016/0128467 | A1 | 5/2016 | Sigal et al. | |
| 2016/0203710 | A1* | 7/2016 | Bataillou | H01H 13/785 340/12.55 |
| 2017/0055720 | A1 | 3/2017 | Lin et al. | |
| 2017/0354244 | A1 | 12/2017 | Lee | |
| 2019/0029412 | A1* | 1/2019 | Gibson | A47B 21/02 |

FOREIGN PATENT DOCUMENTS

| | | | |
|---|---|---|---|
| DE | 102016115244 | | 3/2017 |
| EP | 0922410 | A2 | 6/1999 |
| EP | 1470766 | A1 | 10/2004 |
| EP | 2141718 | A1 | 1/2010 |
| JP | 2003257287 | A | 9/2003 |
| JP | 2006155969 | A | 6/2006 |
| WO | 2003093619 | A1 | 11/2003 |
| WO | 2004040169 | A1 | 5/2004 |
| WO | 2009033486 | A1 | 3/2009 |
| WO | 2010054656 | A1 | 5/2010 |

* cited by examiner

HEIGHT ADJUSTABLE TABLE/DESK CONTROL MECHANISM

CROSS-REFERENCE TO RELATED APPLICATION

This application is a continuation of U.S. application Ser. No. 15/721,253, filed Sep. 29, 2017 (the '253 application), which claims the benefit of U.S. Provisional Patent Application Ser. No. 62/401,729, filed Sep. 29, 2016 (the '729 application), U.S. Provisional Patent Application Ser. No. 62/414,223, filed Oct. 28, 2016 (the '223 application), and U.S. Patent Application Ser. No. 62/402,406, filed Sep. 30, 2016 (the '406 application). The '253 application, the '729 application, the '223 application and the '406 applications are all hereby incorporated by reference as though fully set forth herein.

BACKGROUND

Height adjustable tables/desks may include a control mechanism that a user interacts with to adjust the height of the table or desk. These control systems are often overly complicated and/or unattractive. A control mechanism that is both intuitive and visually attractive may be desirable.

SUMMARY

Various aspects of the present disclosure are directed toward apparatuses, systems, and methods that include a height adjustable table/desk control mechanism as is shown and described in the figures. The height adjustable table/desk control may be configured to interface with a motor or drive mechanism to facilitate a user adjusting a height adjustable table/desk. The height adjustable table/desk control mechanism may be coupled to the adjustable table/desk and may include a lever arm extending from a body portion that allows the user to initiate raising and lowering of the desk.

While multiple embodiments are disclosed, still other embodiments of the present disclosure will become apparent to those skilled in the art from the following detailed description, which shows and describes illustrative embodiments of the disclosed subject matter. Accordingly, the drawings and detailed description are to be regarded as illustrative in nature and not restrictive.

Figure 1A:
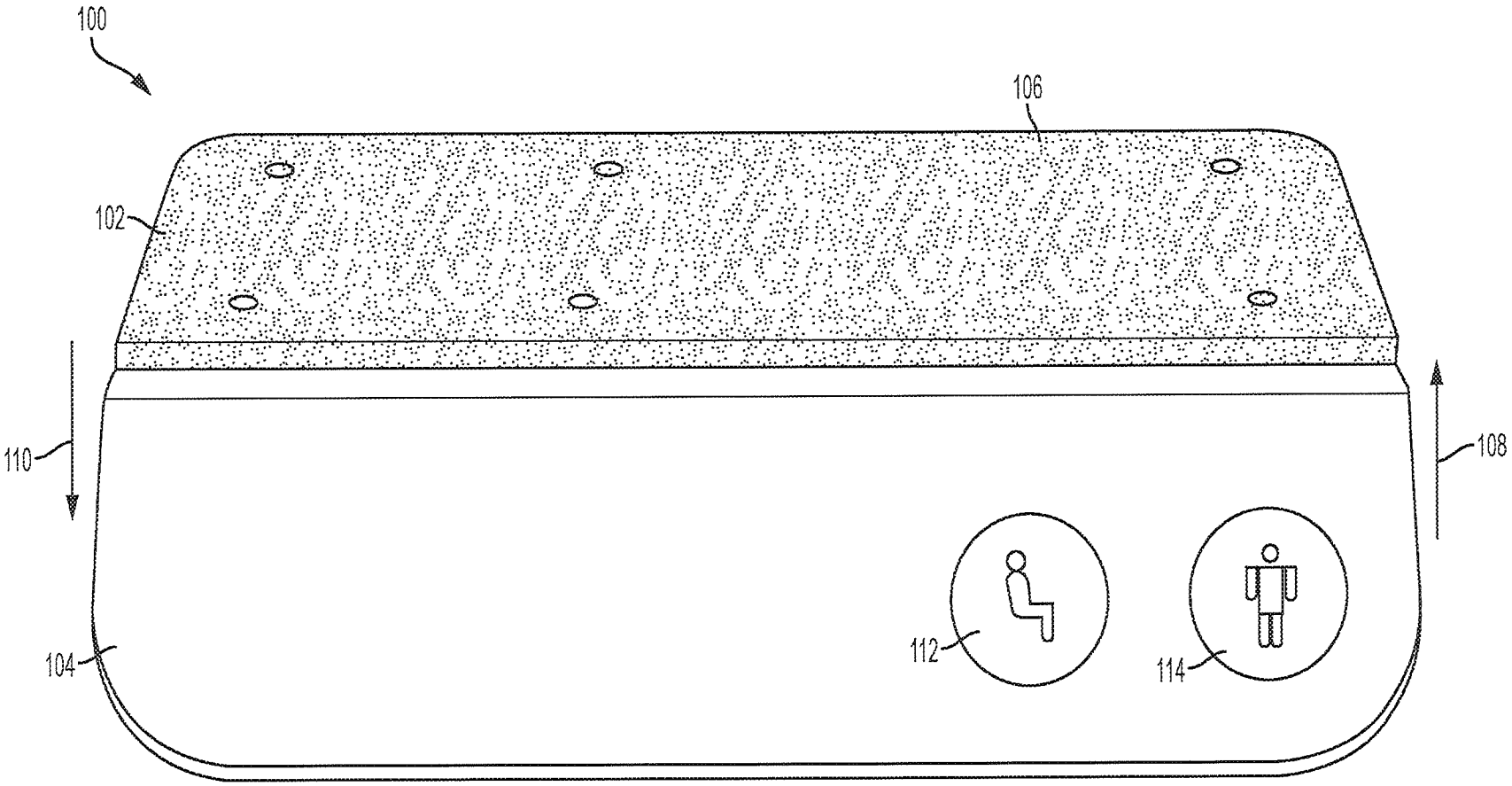
FIG. 1A shows a front view of a height adjustable table/desk control mechanism in according to some examples.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

FIG. 1A shows a front view of a height adjustable table/desk control mechanism 100 in according to some examples. The height adjustable table/desk control mechanism 100 may include a housing 102 and a lever 104 that extends from the housing 102.

Figure 1B:
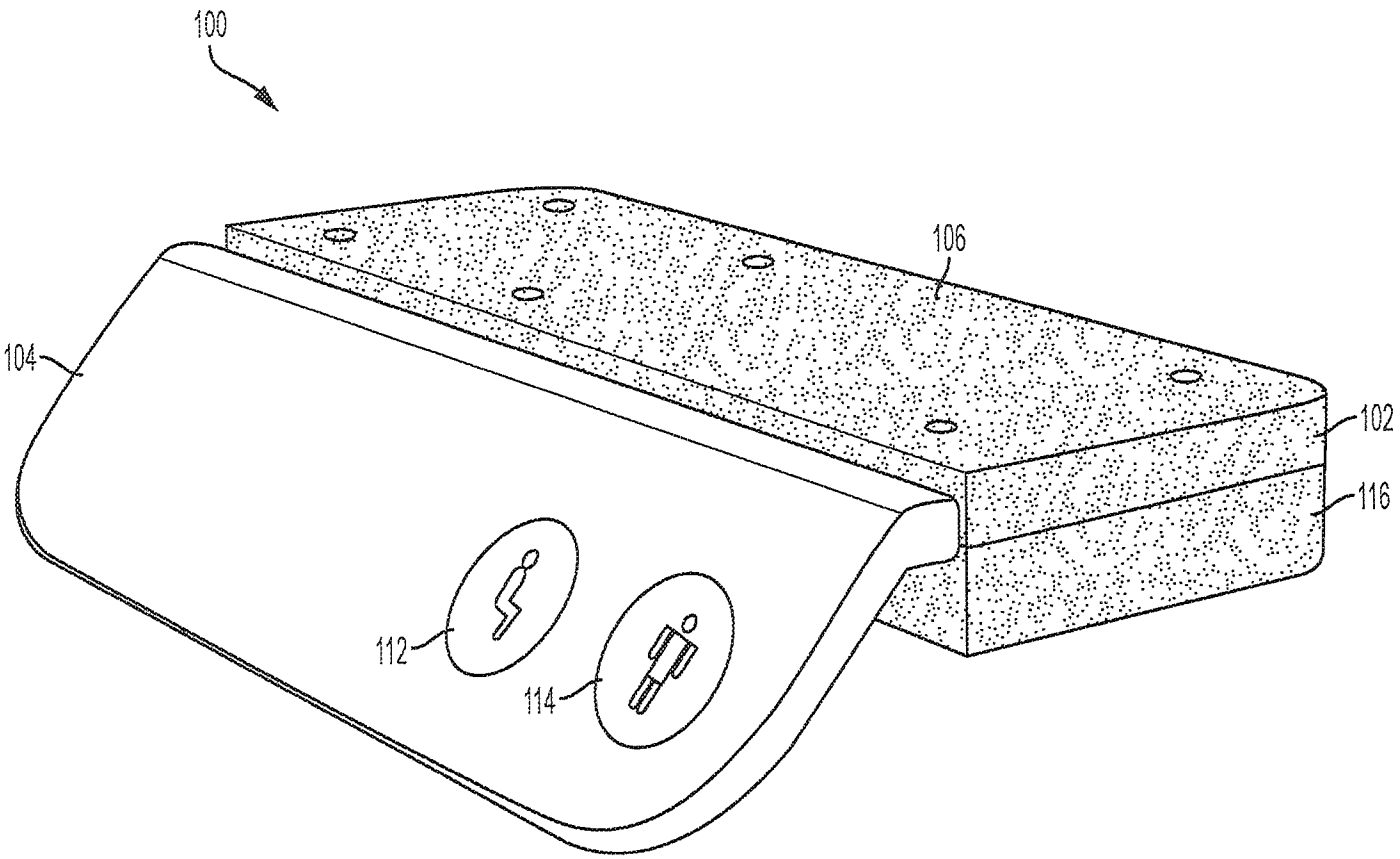
FIG. 1B shows a perspective top view of the height adjustable table/desk control mechanism, shown in FIG. 1A, according to some examples.
Figure 1C:
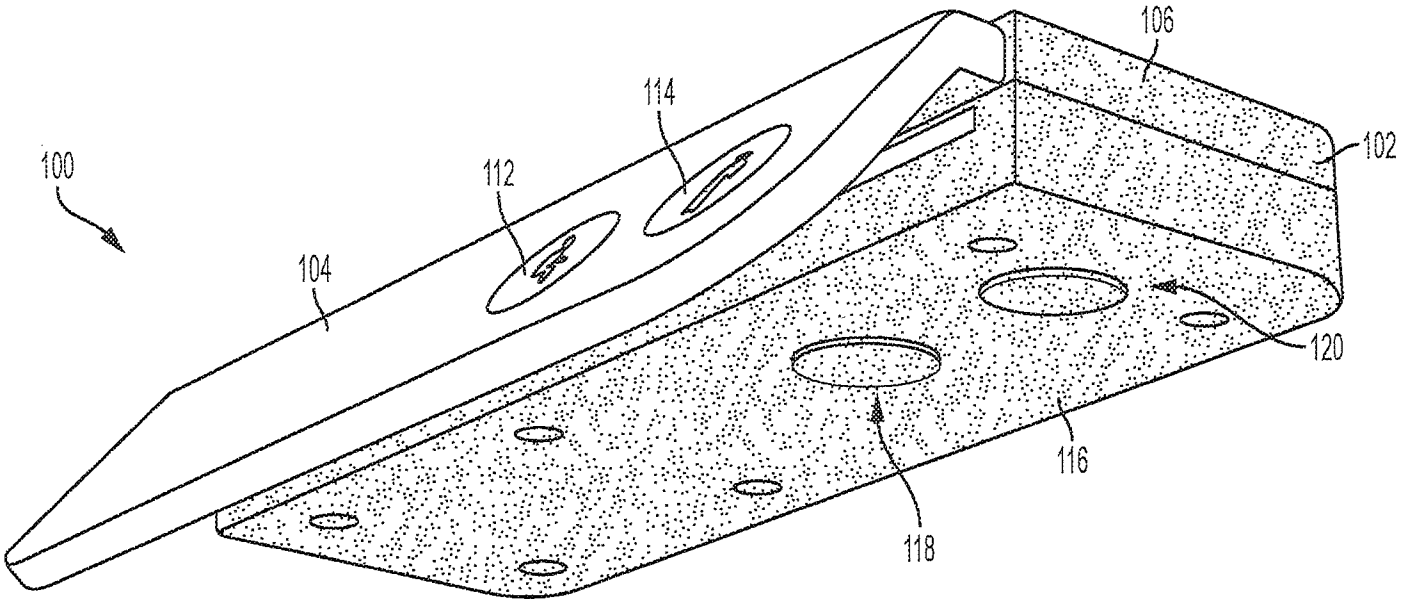
FIG. 1C shows a perspective bottom view of the height adjustable table/desk control mechanism, shown in FIGS. 1A-B, according to some examples.
Figure 1D:
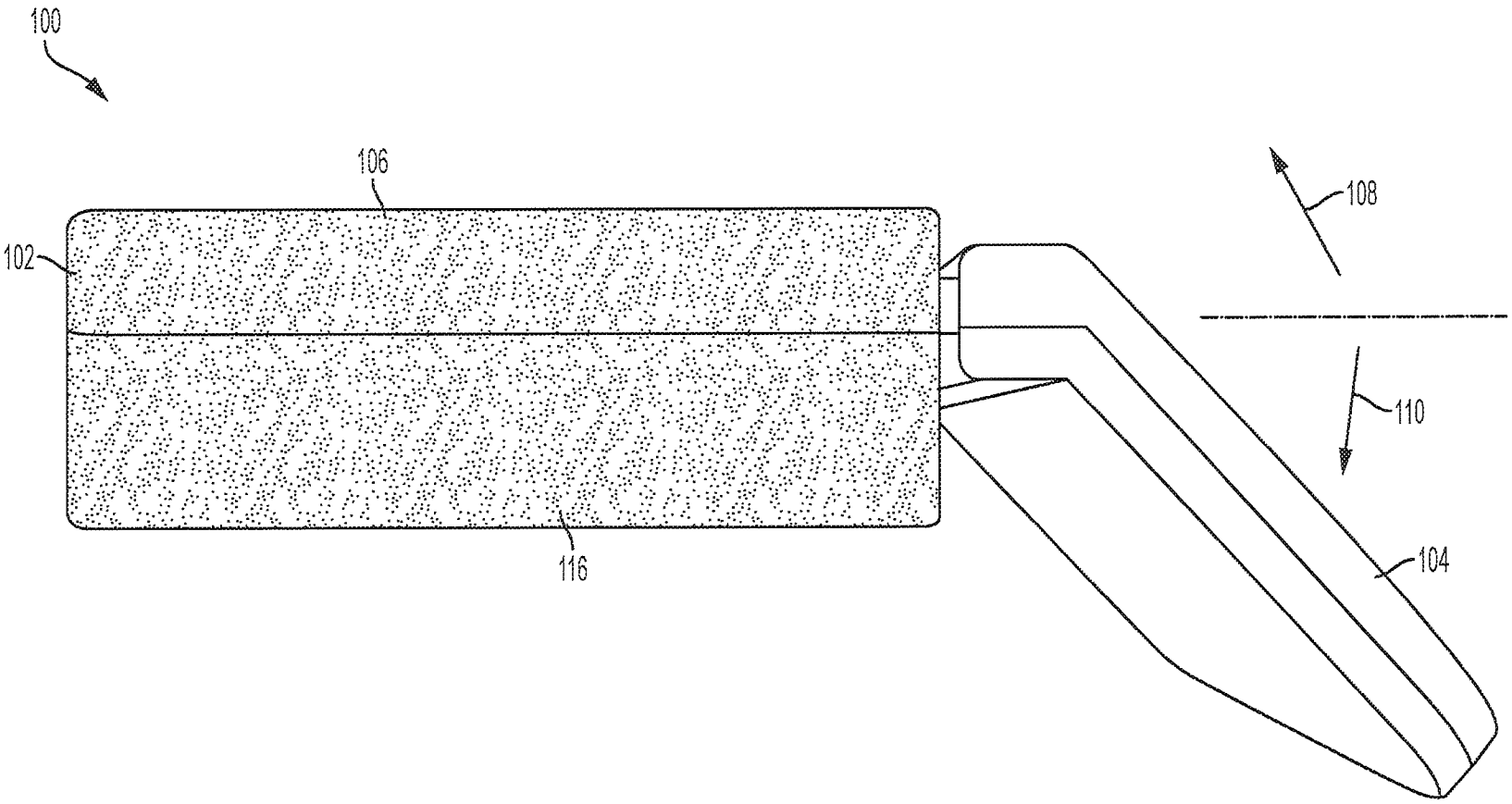
FIG. 1D shows another side view of the height adjustable table/desk control mechanism, shown in FIGS. 1A-C, according to some examples.

The housing 102 may be coupled to a height adjustable desk or table (not shown) via a top surface 106 or a bottom surface (shown in FIGS. 1B-D). As explained in further detail below with reference to FIG. 2, for example, the housing 102 may include control circuitry therein that is coupled to a motor that raises and lowers the height adjustable desk or table. The control circuitry may instruct the motor to raise or lower the desk or table to which the height adjustable table/desk control mechanism 100 is coupled in response to actuation of the lever 104. The lever 104 may be actuated relative to the housing 102 by a user. In certain instances, the lever 104 may be actuated in a first direction 108 to initiate raising the desk or table, and the lever 104 may be actuated in a second direction 110 to initiate lowering the desk or table. The actuation or movement of the lever 104 may provide a tactile feedback to the user to indicate that the raising or lowering of the desk or table is initiated. In other instances, the lever 104 may not actuate or move in response to the user applying a force in the first direction 108 or the second direction 110. However, the force applied to the lever 104 will initiate raising or lowering of the desk or table in response.

The height adjustable table/desk control mechanism 100 may also include a first button 112 and a second button 114 arranged on the lever 104. The first button 112 and the second button 114 may be capacitive touch buttons that are activated by a touch from the user. In other instances, the first button 112 and the second button 114 may be physically pressed to be activated. The first button 112 may be associated with a sitting position for the desk or table as set by the user and the second button 114 may be associated with a standing position for the desk or table as set by the user. In certain instances, the first button 112 may include an icon or display to visually indicate to the user that the first button 112 is associated with the sitting position for the desk or table. Similarly, the second button 114 may include an icon or display to visually indicate to the user that the second button 114 is associated with the standing position for the desk or table. The first button 112 and the second button 114 may be coupled to the control circuitry arranged within the housing 102, which may also store the set sitting position and the set standing position. The control circuitry may also relay to the motor to actuate the desk or table to the standing or sitting position in response to a touch from the user of the associated one of the first button 112 and the second button 114.

FIG. 1B shows a perspective top view and FIG. 1C shows a perspective bottom view of the height adjustable table/desk control mechanism 100, shown in FIG. 1A. Each of FIG. 1B and FIG. 1C show the bottom surface 116 of the housing 102. As shown in further detail in FIG. 1C, the height adjustable table/desk control mechanism 100 may include a first programming button 118 and a second programming button 120. When the height adjustable table/desk control mechanism 100 is mounted to the desk or table, the first programming button 118 and the second programming button 120 may be obstructed from the view of the user. The first programming button 118 may be used to set the sitting position of the desk or table and the second programming button 120 may be used to set the standing position of the desk or table. The user may press and hold the first programming button 118 to set the sitting position of the desk or table. Similarly, the user may press and hold the second programming button 120 to set the standing position of the desk or table. The user may actuate the lever 104 to position the desk or table at the desired sitting or standing position, and the user may use the first programming button 118 and the second programming button 120 to program or set the desired sitting or standing position. FIG. 1D shows another side view of the height adjustable table/desk control mechanism 100, shown in FIGS. 1A-C.

Figure 2A:
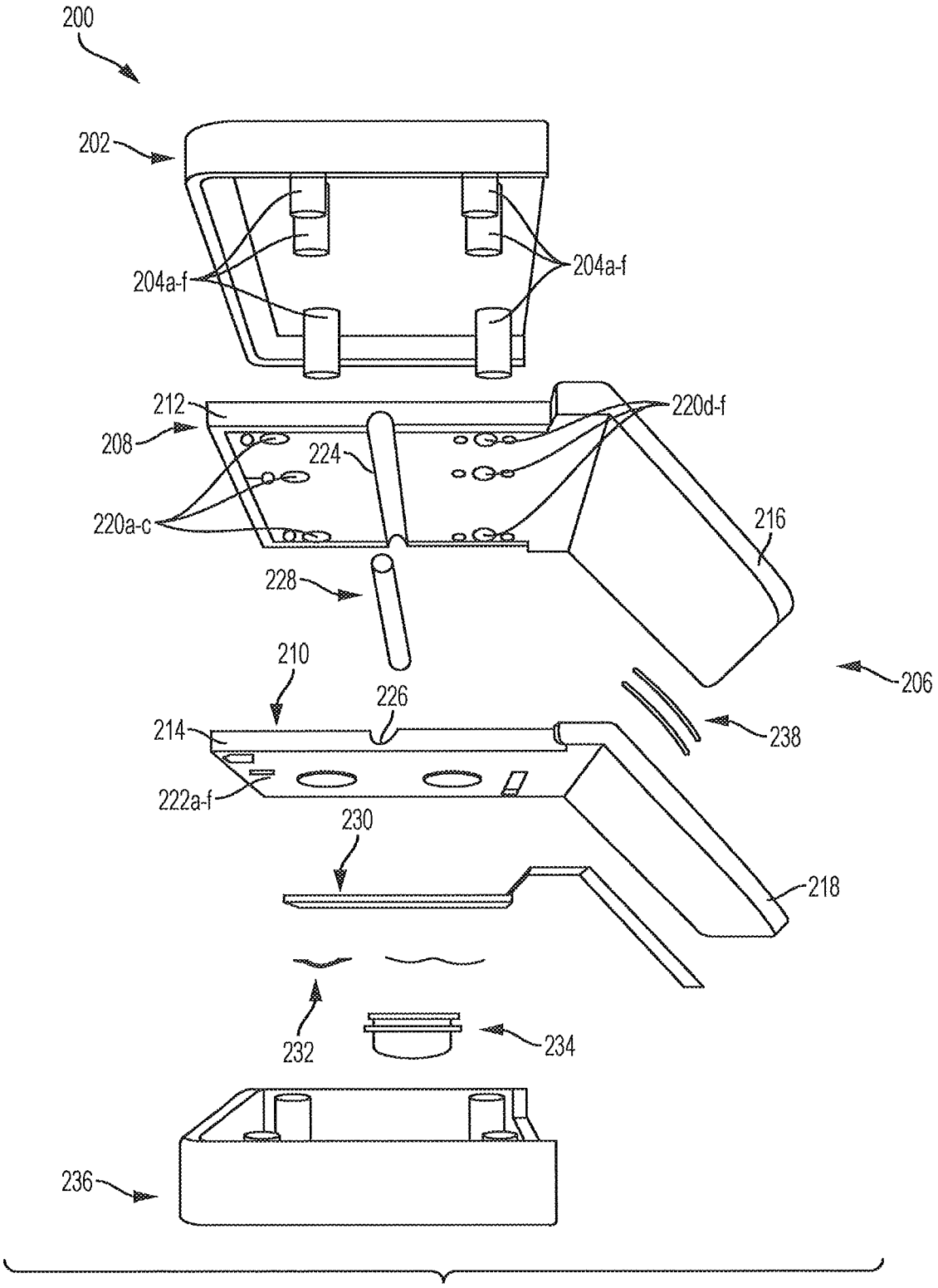
FIG. 2A shows an exploded view of a height adjustable table/desk control mechanism in according to some examples.

FIG. 2A shows an exploded view of a height adjustable table/desk control mechanism 200 in according to some examples. The height adjustable table/desk control mechanism 200 may include an upper housing portion 202 that may include internal bosses 204*a-f* (that include through holes) to provide structural stability when attaching the height adjustable table/desk control mechanism 200 to a height adjustable table or desk. The internal bosses 204*a-f* may also couple the upper housing portion 202 to the remaining portions of the height adjustable table/desk control mechanism 200 and to a lower housing portion 236 to provide an enclosed height adjustable table/desk control mechanism 200. For example, the internal bosses 204*a-f* may couple the upper housing portion 202 to a lever 206.

The lever may include an upper lever portion 208 and a lower lever portion 210. Each of the upper lever portion 208 and the lower lever portion 210 include horizontal portions 212, 214 and angled portions 216, 218. Each of the horizontal portions 212, 214 include through holes 220*a-f* and 222*a-f* that pass the internal bosses 204*a-f* therethrough to the lower housing portion 236. Each of the upper lever portion 208 and the lower lever portion 210 may include channels 224, 226 that may surround a pin 228. The pin 228 may interface with the upper housing portion 202 and the lower housing portion 236 to provide a pivot point to actuate the lever 206. As noted above, for example with reference to FIG. 1, a user may use the lever 206 to raise and lower the height adjustable table or desk (e.g., as described above with reference to FIG. 1). The lever 206 is pivoted toward the upper housing portion 202 to raise the height adjustable table or desk, and pivoted toward the lower housing portion 236 to lower the height adjustable table or desk.

In certain instances, the horizontal portions 212, 214 may be arranged within the bounds of the upper housing portion 202 and the lower housing portion 236. The horizontal portions 212, 214 may be enclosed by the upper housing portion 202 and the lower housing portion 236. The user may use the angled portions 216, 218 of the lever 206 to raise and lower the height adjustable table or desk. The angled portions 216, 218 of the lever 206 may be arranged outside the bounds of the upper housing portion 202 and the lower housing portion 236.

The height adjustable table/desk control mechanism 200 may also include one or more capacitive touch pads 238. The capacitive touch pads 238 may be arranged between the angled portions 216, 218 of the lever 206. The capacitive touch pads 238 may be associated with a set sitting position and a set standing position for the desk or table. The capacitive touch pads 238 may be coupled a printed circuit board (PCB) 230 via a flexible cable (not shown). The angled portion 216 of the upper lever portion 208 may include to indicate to the user contact points for icons (shown in FIG. 2B) associated with the capacitive touch pads 238. In this manner, the user may visualize where to touch the portion of the lever 206 in order to move the desk to the set sitting position or the set standing position without having a physical/mechanical button arranged on the lever 206.

The PCB 230 may include control circuitry that relays information to a motor (configured to raise and lower the desk or table) arranged with the desk or table via wires (not shown) coupled to the PCB 230 and the motor. For example, in response to raising or lowering of the lever 206, the PCB 230 will relay a corresponding signal to the motor to raise or lower the desk or table. The PCB 230 may be coupled to switches 232. The switches 232 may be mechanical dome switches, which may be compressed in response to actuation of the lever 206. One of the switches 232 may be compressed when the user raises the lever 206, and the other of the switches 232 may be compressed when the user lowers the lever 206. The switches 232 may concentrate the force that results from pivoting of the horizontal portions 212, 214. The switches 232 collapse in response to the force to close a circuit with the PCB 230. Once the force is no longer applied, the switches 232 snap back and the circuit is open. Compressing the switches 232 may prompt the PCB 230 to send signals to the motor to the motor to raise or lower the desk or table in response to moving the lever 206.

Figure 2B:
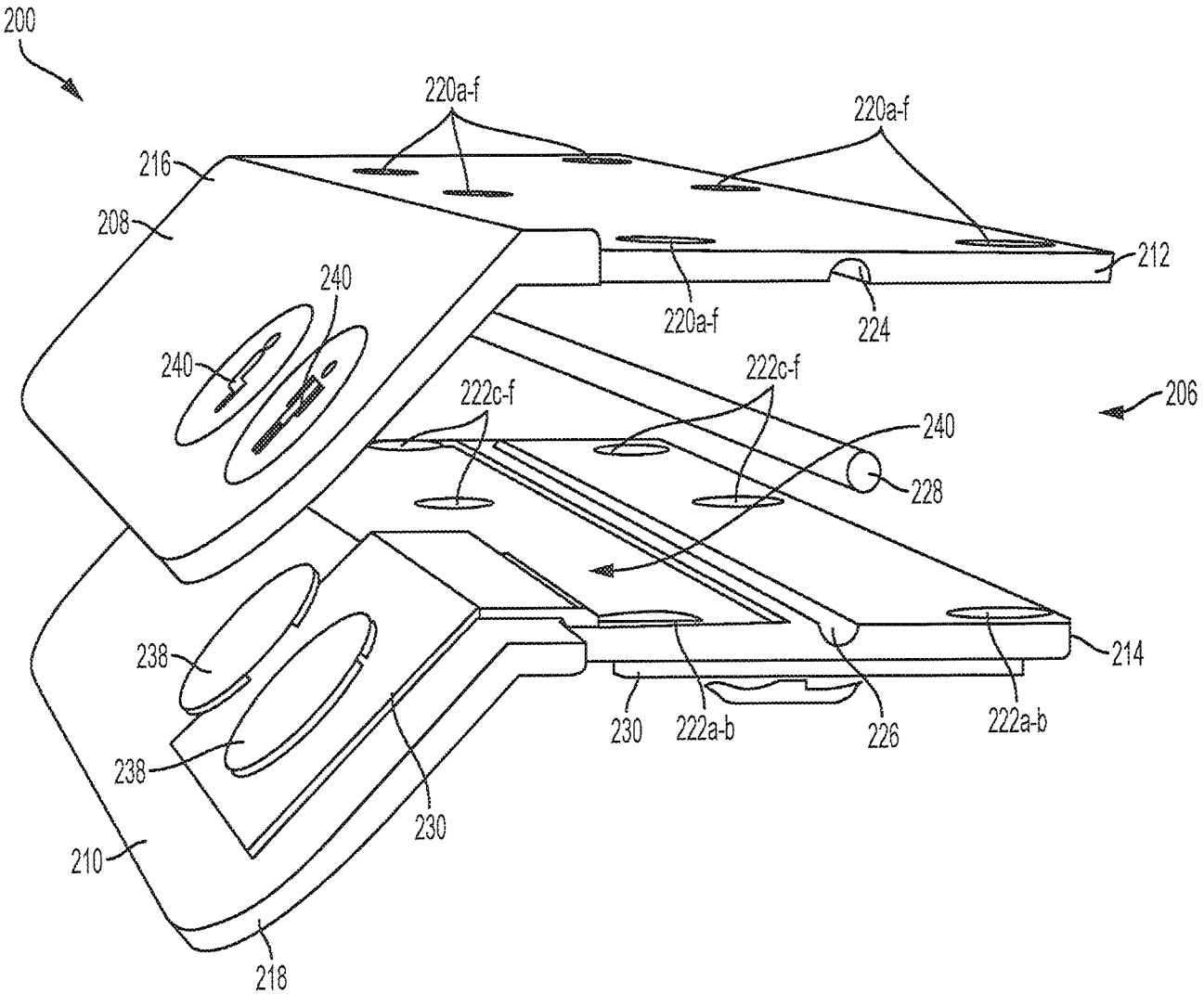
FIG. 2B shows another exploded view of the height adjustable table/desk control mechanism shown in FIG. 2A in according to some examples.

In addition, the PCB 230 will relay a signal to the motor to raise or lower the desk or table to the set sitting position or set standing position in response to the user touching a respective one of the capacitive touch pads 238. The PCB 230 may include a portion arranged with the horizontal portions 212, 214 and a portion arranged with the angled portions 216, 218. The PCB 230 may contact at least a portion of one or both of the angled portion 216, 218. In certain instances, the PCB 230 may be arranged between the lower lever portion 210 and the lower housing portion 236 (as shown in FIG. 2), the PCB 230 may be arranged between the upper lever portion 208 and the upper housing portion 202, the PCB 230 may be arranged between the upper lever portion 208 and the lower lever portion 210, or portions of the PCB 230 may be arranged between the upper lever portion 208 and the lower lever portion 210 with other portions of the PCB 230 being arranged the lower lever portion 210 and the lower housing portion 236 (e.g., as shown in FIG. 2B). The PCB 230 may be arranged in this manner to couple both to the capacitive touch pads 238 and to the switches 232.

The PCB 230 may also be coupled to buttons 234 that extend through the lower housing portion 236. The user may press (and hold) the buttons 234 to program the set standing position and set sitting position for the desk or table that is associated with the capacitive touch pads 238.

FIG. 2B shows another exploded view of the height adjustable table/desk control mechanism 200 shown in FIG. 2A including icons 240 associated with the capacitive touch pads 238.

The illustrative components shown in FIGS. 2A-B are not intended to suggest any limitation as to the scope of use or functionality of embodiments of the disclosed subject matter. Neither should the illustrative components be interpreted as having any dependency or requirement related to any single component or combination of components illustrated therein. Additionally, any one or more of the components depicted in any of the FIGS. 2A-B may be, in embodiments, integrated with various other components depicted therein (and/or components not illustrated), all of which are considered to be within the ambit of the disclosed subject matter.

Figure 3A:
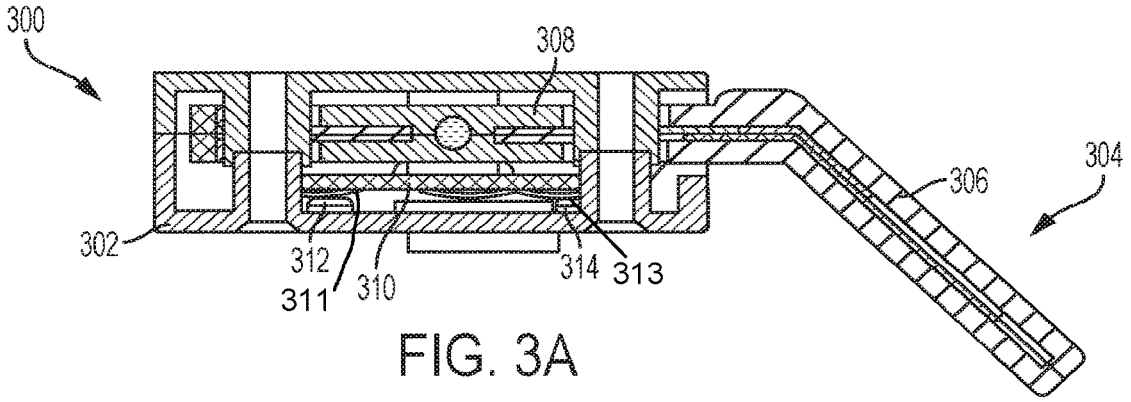
FIG. 3A shows a side view of a height adjustable table/desk control mechanism in a neutral configuration according to some examples.

FIG. 3A shows a side view of a height adjustable table/desk control mechanism 300 in a neutral configuration according to some examples. The height adjustable table/desk control mechanism 300 may include a housing 302 and a lever 304. The lever 304 may include an angled portion 306 that extends from the housing 302 and a horizontal portion 308 arranged within the housing 302. A user may manipulate the lever 304 by the angled portion 306 to effect raising and lowering of a table or desk to which the height adjustable table/desk control mechanism 300 is attached.

The height adjustable table/desk control mechanism 300 may also include a printed circuit board (PCB) 310 arranged within the housing 302 and coupled to the lever 304. In certain instances, the PCB 310 may be arranged within the angled portion 306. The PCB 310 may be configured to instruct a motor (configured to raise and lower the desk or table to which the height adjustable table/desk control mechanism 300 is attached) to raise or lower the in response to table or desk in response to manipulation of the lever 306. The PCB 310 may compress a first dome switch 311 and a second dome switch 313 in response to a user applying force to the lever 306. The bottom housing has small nubs 312 and 314 that push in the dome switches.

Figure 3B:
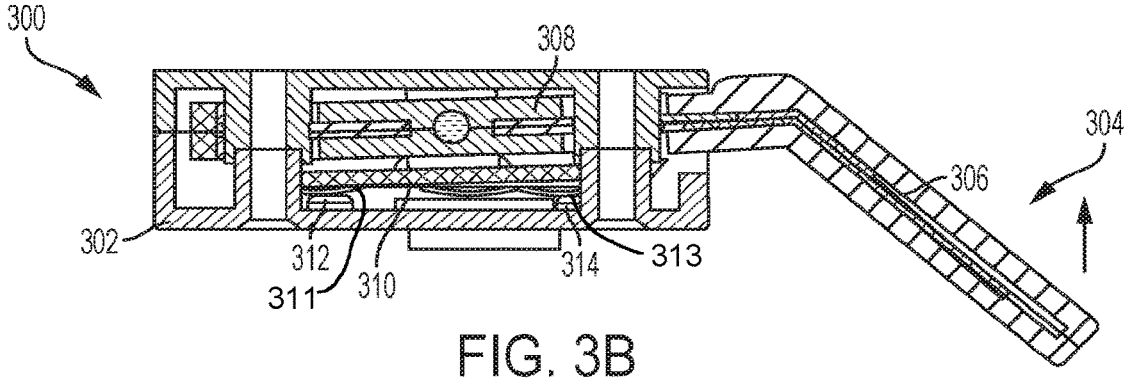
FIG. 3B shows a side view of the height adjustable table/desk control mechanism, shown in FIG. 3A, in a raising configuration according to some examples.

FIG. 3B shows a side view of the height adjustable table/desk control mechanism 300 shown in FIG. 3A, in a raising configuration according to some examples. As shown in FIG. 3B, the user has raised the lever 304. The horizontal portion 308 may compress the first dome switch 311. This compression causes the PCB 310 to send signals to the motor to raise the desk or table. Once the desk or table is raised to a desired position, the user may no longer apply force to the lever 306 and the horizontal portion 308 will stop compressing the first dome switch 311. As a result, the PCB 310 will stop sending signals to the motor, and the table or desk will stop being raised.

Figure 3C:
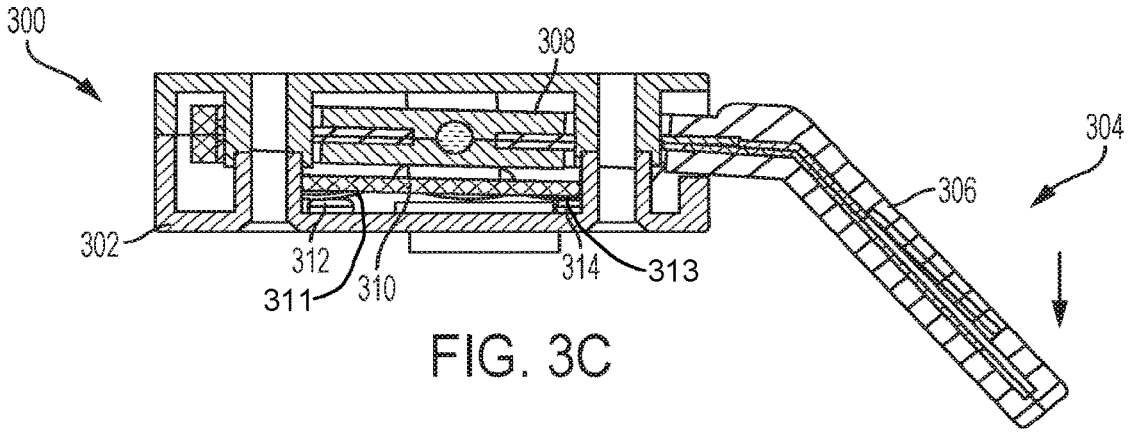
FIG. 3C shows a side view of the height adjustable table/desk control mechanism, shown in FIG. 3A-B, in a lowering configuration according to some examples.

FIG. 3C shows a side view of the height adjustable table/desk control mechanism 300 shown in FIG. 3A-3B, in a lowering configuration according to some examples. As shown in FIG. 3C, the user has pressed the lever 304 downward. The horizontal portion 308 may compress the second dome switch 313. This compression causes the PCB 310 to send signals to the motor to lower the desk or table. Once the desk or table is lowered to a desired position, the user may no longer apply force to the lever 306 and the horizontal portion 308 will stop compressing the first dome switch 313. As a result, the PCB 310 will stop sending signals to the motor, and the table or desk will stop being lowered.

In certain instances, the angled portion 306 may pivot along with the horizontal portion 308 of the lever 306. The angled portion 306 pivoting may provide a tactile indication to the user that the desk or table is being raised or lowered. This pivoting action of the angled portion 306 is shown in FIGS. 3B-C.

The illustrative components shown in FIGS. 3A-C are not intended to suggest any limitation as to the scope of use or functionality of embodiments of the disclosed subject matter. Neither should the illustrative components be interpreted as having any dependency or requirement related to any single component or combination of components illustrated therein. Additionally, any one or more of the components depicted in any of the FIGS. 3A-C may be, in embodiments, integrated with various other components depicted therein (and/or components not illustrated), all of which are considered to be within the ambit of the disclosed subject matter. For example, the height adjustable table/desk control mechanism 300 may include capacitive touch switches and/or buttons as is discussed in further detail with reference to FIGS. 1-2.

Figure 4A:
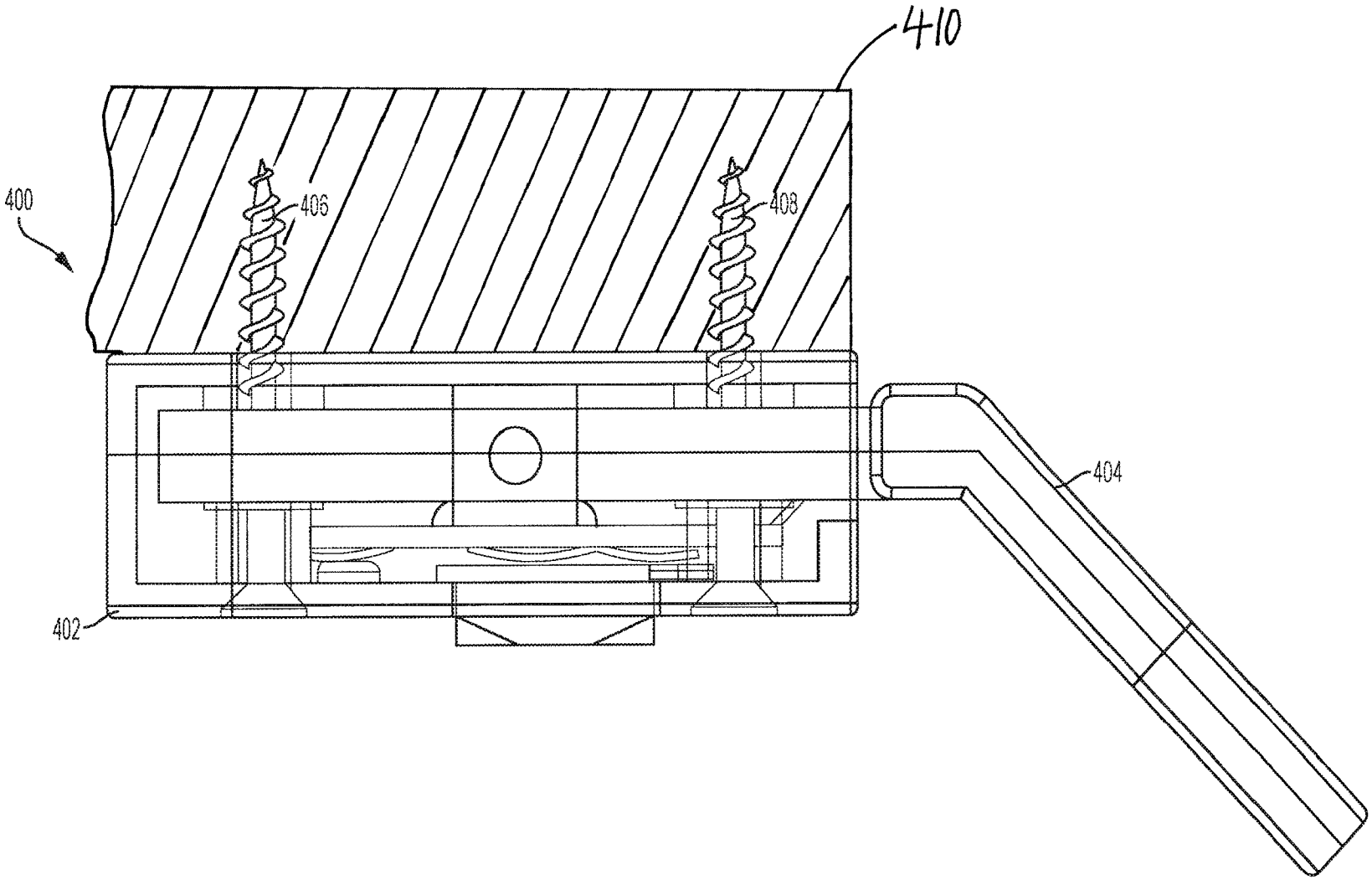
FIG. 4A shows a side cross section view of a height adjustable table/desk control mechanism in according to some examples.

FIG. 4A shows a side partially cross sectioned view of a height adjustable table/desk control mechanism 400 in according to some examples. The height adjustable table/desk control mechanism 400 may include a housing 402 and a lever 404 (consistent with various aspects discussed above). The adjustable table/desk control mechanism 400 may be attached to a desk or table 410 via screws 406, 408 arranged through the housing 402.

Figure 4B:
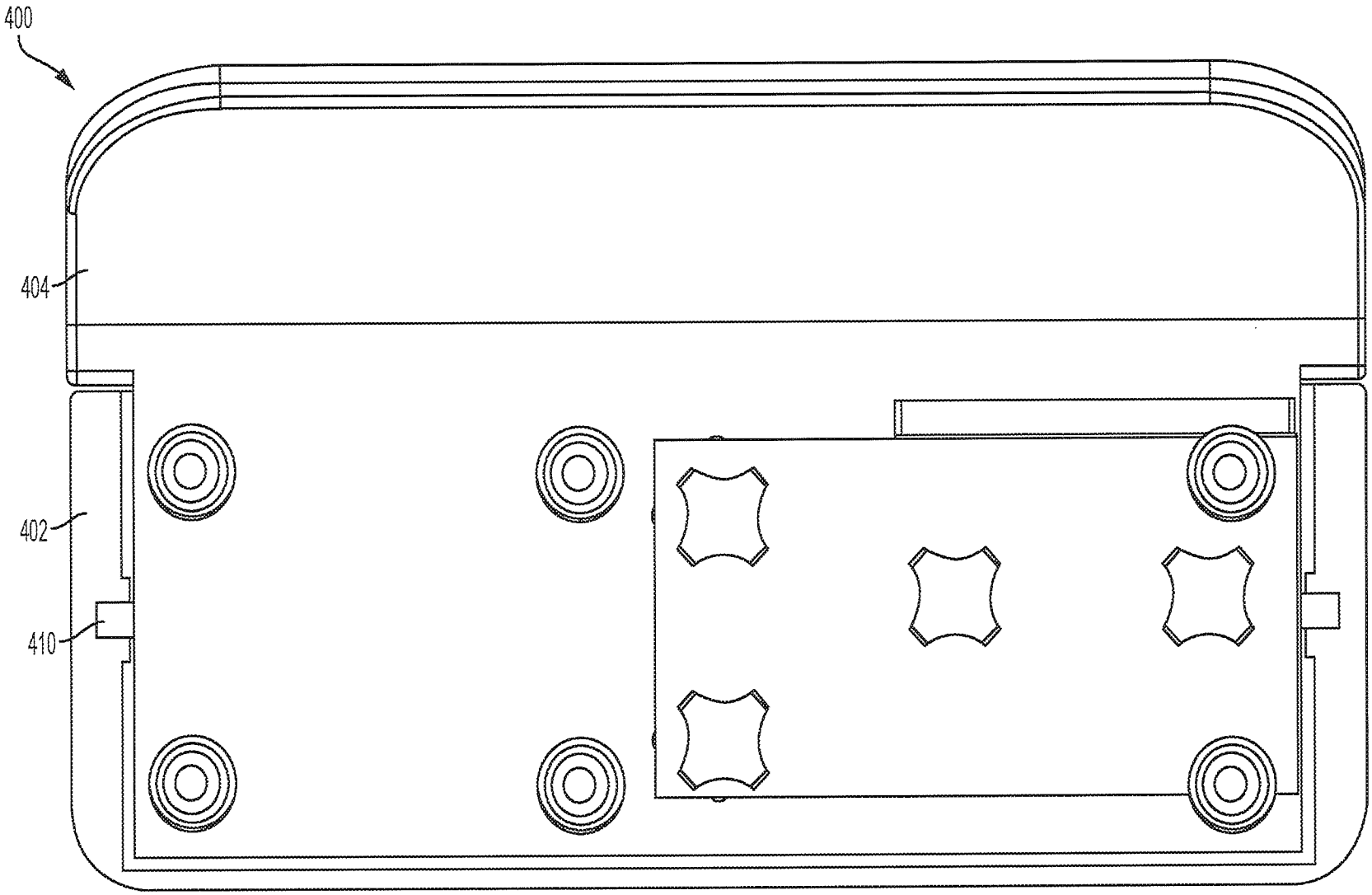
FIG. 4B shows bottom partially exploded view of a height adjustable table/desk control mechanism, shown in FIG. 4A, in according to some examples.

FIG. 4B shows bottom partially exploded view of a height adjustable table/desk control mechanism 400, shown in FIG. 4A, in according to some examples. As noted above, for example with reference to FIGS. 1-3, the lever 404 may pivot relative to the housing 402. The lever 404 may be coupled to the housing 402 via a pin 410 that may act as a fulcrum point for the lever 404.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. An apparatus for controlling movement of a desk or table, said apparatus comprising:

a lever configured to be manipulated by a user to effect raising or lowering of the desk or table;

a housing, wherein said lever comprises a first portion that extends from said housing and a second, horizontal portion arranged within said housing;

a first dome switch;

a second dome switch, wherein said first dome switch is disposed in said housing and said second dome switch is disposed in said housing; and control circuitry configured to instruct coupled to a motor to raise or lower the desk or table in response to manipulation of said lever;

a printed circuit board (PCB) wherein said PCB includes said control circuitry and wherein said first and second dome switches are coupled to said PCB;

wherein when said first portion of said lever is moved in a first direction, said second, horizontal portion of said lever causes said first dome switch to be compressed causing signals to be sent for causing the motor to raise the desk or table, and wherein when said first portion of said lever is moved in a second direction, said second, horizontal portion of said lever causes said second dome switch to be compressed causing signals to be sent for causing the motor to lower the desk or table.

2. The apparatus of claim 1 wherein said PCB is coupled to said lever and configured to compress said first dome switch when said first portion of said lever is moved in said first direction and to compress said second dome switch when said first portion of said lever is moved in said second direction.

3. The apparatus of claim 2 wherein said first portion of said lever is moved in said first direction by a user applying a force thereto, and wherein when the user no longer applies the force to said lever, said second, horizontal portion of said lever will stop causing said first dome switch being compressed and as a result, said signals for causing the motor to raise the table or desk will be stopped thereby stopping said table or desk being raised.

4. The apparatus of claim 2 wherein said first portion of said lever is moved in said second direction by a user applying a force thereto, and wherein when the user no longer applies the force to said lever, said second, horizontal portion of said lever will stop causing said second dome switch being compressed and as a result, said signals for causing the motor to lower the table or desk will be stopped thereby stopping said table or desk being lowered.

5. The apparatus of claim 1 wherein said first portion of said lever is angled with respect to said second, horizontal portion.

6. The apparatus of claim 5 wherein said first, angled portion has a first button arranged thereon, said first button being coupled to said control circuitry, which stores a sitting position and wherein said control circuitry is configured to relay signal for causing the motor to actuate the desk or table to said sitting position in response to activation of said first button.

7. The apparatus of claim 6 wherein said first, angled portion has a second button arranged thereon, said second button being coupled to said control circuitry, which stores a standing position and wherein said control circuitry is configured to relay signals for causing the motor to actuate the desk or table to said standing position in response to activation of said second button.

8. The apparatus of claim 7 wherein said first and second buttons comprise capacitive touch buttons.

9. The apparatus of claim 7 wherein said first and second buttons are configured to be activated by a physical press.

10. The apparatus of claim 7 further comprising one or more programming buttons configured to program at least one of (i) said sitting position of the desk or table and (ii) said standing position of the desk or table.

11. The apparatus of claim 1 wherein said apparatus includes a neutral configuration where said lever is neither raised nor lowered, said apparatus further including a raising configuration when said first portion of said lever is raised in said first direction, said apparatus further including a lowering configuration when said first portion of said lever is lowered in said second direction.

12. The apparatus of claim 1 wherein said lever is configured to pivot.

13. The apparatus of claim 1 wherein said lever has a first button arranged thereon, said first button being coupled to said control circuitry, which stores a sitting position and wherein said control circuitry is configured to relay signals for causing the motor to actuate the desk or table to said sitting position in response to activation of said first button.

14. The apparatus of claim 13 wherein said lever has a second button arranged thereon, said second button being coupled to said control circuitry, which stores a standing position and wherein said control circuitry is configured to relay signals for causing the motor to actuate the desk or table to said standing position in response to activation of said second button.

15. The apparatus of claim 1 wherein said housing is configured to allow said apparatus to be attached to the desk or table.

16. An apparatus for controlling movement of a desk or table, said apparatus comprising:

a lever configured to be manipulated by a user to effect raising or lowering of the desk or table; and control circuitry coupled to a motor to raise or lower the desk or table in response to manipulation of said lever;

wherein said lever including a first button arranged thereon, said first button being coupled to said control circuitry, which stores a sitting position, and wherein said control circuitry is configured to relay signals for causing the motor to actuate the desk or table to the sitting position in response to activation of said first button, said lever including a second button arranged thereon, said second button being coupled to said control circuitry, which stores a standing position, and wherein said control circuitry is configured to relay signals for causing the motor to actuate the desk or table to the standing position in response to activation of said second button; and a housing, and wherein said lever comprises a first portion that extends from said housing and a second, horizontal portion arranged within said housing.

17. The apparatus of claim 16 wherein said first and second buttons comprise capacitive touch buttons.

18. The apparatus of claim 16 wherein said first and second buttons are configured to be activated by a physical press.

19. The apparatus of claim 16 further comprising one or more programming buttons configured to program at least one of said sitting and standing position of the desk or table.

* * * * *